US005781961A

United States Patent [19]

Thur et al.

[11] Patent Number: 5,781,961

[45] Date of Patent: Jul. 21, 1998

[54] CONDUIT FOR A VACUUM CLEANER

[75] Inventors: Charles J. Thur, Broadview Heights; Mark E. Cipolla, Chardon, both of Ohio

[73] Assignee: Royal Appliance Mfg. Co., Cleveland, Ohio

[21] Appl. No.: 488,794

[22] Filed: Jun. 8, 1995

[51] Int. Cl.[6] ..... A47L 9/14

[52] U.S. Cl. ..... 15/327.2; 15/327.7; 15/350

[58] Field of Search ..... 15/347, 350, 327.1, 15/327.2, 327.7; 55/374

[56] References Cited

U.S. PATENT DOCUMENTS

| | | | |
|---|---|---|---|
| 2,516,883 | 8/1950 | Kelly . | |
| 2,516,907 | 8/1950 | Penfold . | |
| 2,719,600 | 10/1955 | Brace . | |
| 2,951,714 | 9/1960 | Carlberg . | |
| 3,137,023 | 6/1964 | Klinge et al. . | |
| 3,142,857 | 8/1964 | Fresard et al. | 15/327.7 |
| 3,149,362 | 9/1964 | Smithson . | |
| 3,869,751 | 3/1975 | Boyd et al. . | |
| 3,870,491 | 3/1975 | Friesen | 15/351 X |
| 4,122,579 | 10/1978 | Parise | 15/353 |
| 4,257,789 | 3/1981 | Leinfelt . | |
| 4,380,845 | 4/1983 | Miller et al. . | |
| 4,449,737 | 5/1984 | Specht . | |
| 4,469,498 | 9/1984 | Fish | 55/374 X |
| 4,618,195 | 10/1986 | Keane . | |
| 4,720,887 | 1/1988 | Bosvi et al. . | |
| 4,893,376 | 1/1990 | Sunagawa et al. . | |
| 5,089,038 | 2/1992 | Kopco et al. . | |
| 5,369,839 | 12/1994 | Worwag | 15/353 X |
| 5,408,722 | 4/1995 | Berfield . | |
| 5,511,280 | 4/1996 | Jankowski | 15/352 X |

FOREIGN PATENT DOCUMENTS 740546 11/1955 United Kingdom .

*Primary Examiner*—Chris K. Moore

[57] ABSTRACT

A container construction for a vacuum cleaner includes a housing enclosing a dirt receptacle for the vacuum cleaner, the housing having a wall. A hole extends through the wall of the housing and a tubular conduit extends through the hole in the wall. The conduit has an inlet end located outside the housing and an outlet end located inside the housing. The conduit includes a flange extending radially outwardly from an outer periphery of the conduit, the flange being sized to contact the wall of the housing. The conduit also includes a rib extending radially outwardly from the conduit outer periphery in spaced relation to the flange. A clamp cooperates with the rib and the housing to secure the conduit to the housing.

22 Claims, 5 Drawing Sheets

CONDUIT FOR A VACUUM CLEANER

BACKGROUND OF THE INVENTION

This invention pertains to vacuum cleaners. More particularly, the present invention relates to a means for securing a conduit to a housing of a vacuum cleaner.

Vacuum cleaners use a motorized fan to draw dust laden air from a surface to be cleaned into a dust or dirt receptacle, usually held in a housing. The dirt receptacle holds the dust for disposal at a later time. Many vacuum cleaners make use of a tubular conduit between a nozzle of the vacuum cleaner and the dirt receptacle. Once such tubular conduit for an upright style hard shell vacuum cleaner is disclosed in U.S. Pat. No. 5,089,038. In this construction, a flexible tube extends from a nozzle of the vacuum cleaner and communicates with an inlet end of a rigid upper fill tube. The rigid upper fill tube extends through a wall of a rigid housing and an outlet of the fill tube communicates with a flexible dirt collecting bag held in the housing.

While this design has performed adequately, one problem with the present fill tube design is that due to the dimensional tolerances of the blow molded plastic parts from which the fill tube and the housing are made, sometimes the fill tube wobbles in the housing. On rare occasions, it can become detached from the housing altogether. It would be beneficial to more securely support the fill tube in the housing of the vacuum cleaner in order to make sure that the fill tube cannot work loose while the vacuum cleaner is in use.

Accordingly, it has been considered desirable to develop a new and improved conduit construction for a vacuum cleaner which would overcome the foregoing difficulties and others and meet the above-stated needs while providing better and more advantageous overall results.

BRIEF SUMMARY OF THE INVENTION

In accordance with the present invention, a new and improved container construction is provided for a vacuum cleaner.

More particularly in accordance with this aspect of the invention, the construction comprises a housing enclosing a dirt receptacle for the vacuum cleaner, the housing including a wall. A hole extends through the wall of the housing and a tubular conduit extends through the hole in the wall. The conduit has an inlet end located outside the housing and an outlet end located inside the housing. The conduit comprises a flange extending radially outwardly from an outer periphery of the conduit, the flange being sized to contact the wall of the housing and a rib extending radially outwardly from the conduit outer periphery in spaced relation to the flange. A clamp cooperates with the rib and the housing to secure the conduit to the housing.

Preferably, the container construction further comprises a support arm extending within the housing for supporting the conduit in the housing. If desired, the container construction can further comprise a support finger extending within the housing, a socket located in the support finger and a fastener extending through an aperture in the clamp and into the socket for fastening the clamp to the housing and thereby securing the conduit to the housing. Preferably, the rib and the clamp have mating tapered surfaces to tightly interengage the clamp with the conduit. If desired, the conduit flange can include a shoulder which abuts a wall section of the housing surrounding the hole. Preferably the conduit has an outer surface, including a flat which cooperates with a suitably shaped portion of the housing wall adjacent the aperture to prevent a rotation of the conduit in the housing. Preferably the inlet end of the conduit cooperates with and receives dust laden air from an associated tube and the outlet end cooperates with, and is selectively attached to, a bag located in the housing.

One advantage of the present invention is the provision of a new and improved conduit for a vacuum cleaner.

Another advantage of the present invention is the provision of a rigid tubular conduit which transfers dust laden air from a surface to be cleaned to a dust receptacle located in a housing of a vacuum cleaner.

Still another advantage of the present invention is the provision of a tubular conduit which is rigidly secured to a housing of a vacuum cleaner so as to prevent any wobble or wiggle of the conduit during use of the vacuum cleaner and during the process of removing a filled dust receptacle from the vacuum cleaner and securing an empty one in its place.

Yet another advantage of the present invention is the provision of a vacuum cleaner tubular conduit which has a higher level of reliability in use.

A further advantage of the present invention is the provision of a vacuum cleaner tubular conduit which does not rotate in relation to the housing wall through which it extends.

A still further advantage of the present invention is the provision of a tubular vacuum cleaner conduit which is easy to manufacture and can be readily installed during the assembly of the vacuum cleaner.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 4:
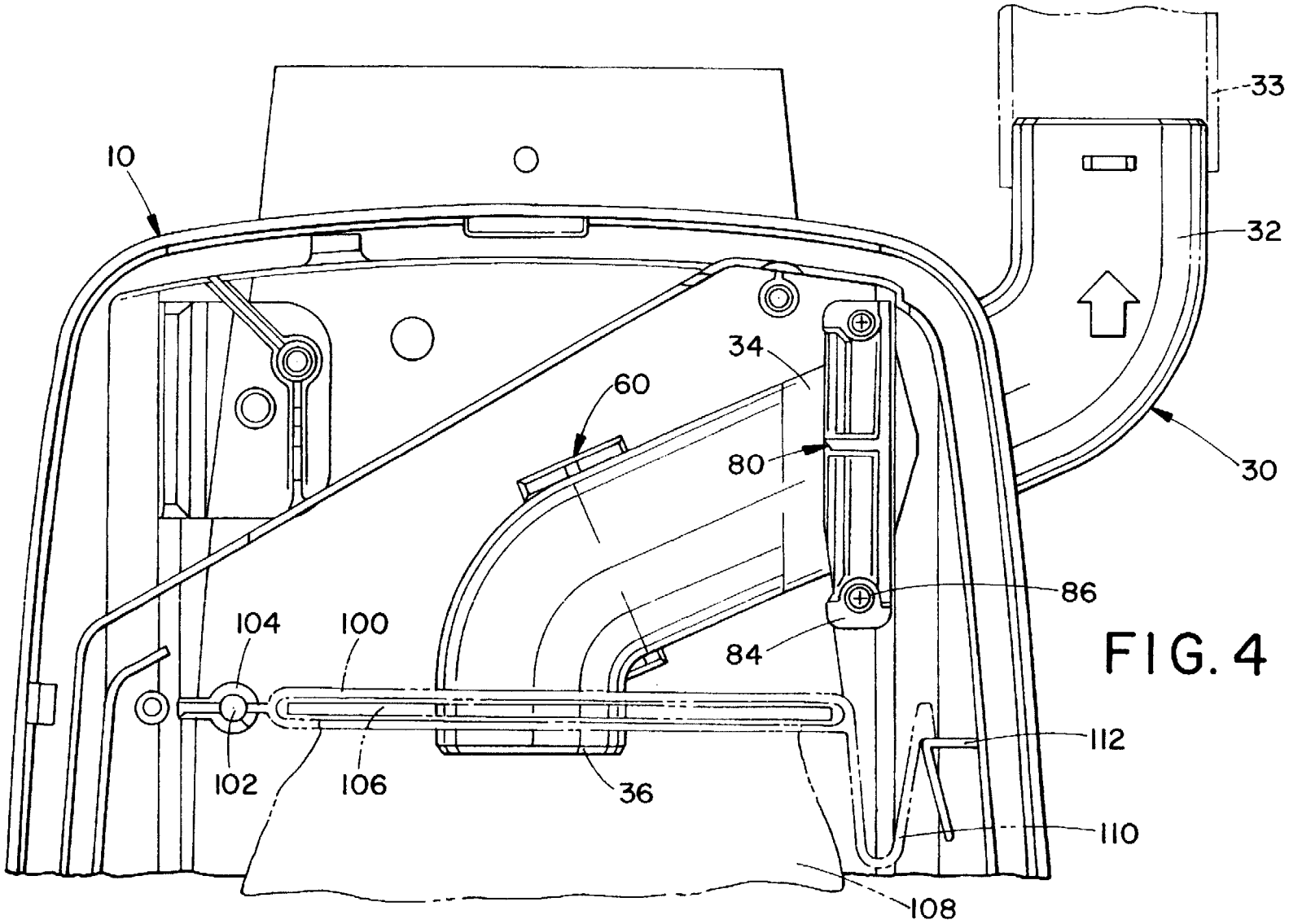
FIG. 4 is an enlarged front elevational view of the conduit, housing and clamp of FIG. 1 in an assembled condition.

Referring now to the drawings wherein the showings are for purposes of illustrating a preferred embodiment of the invention only and not for purposes of limiting same, FIG. 4 shows a conduit that is mounted in a vacuum cleaner housing via a clamp, according to the present invention. While the vacuum cleaner housing is shown to be a hard shell upright vacuum cleaner, it should be appreciated by those of average skill in the art that the invention can also be used in a canister-type vacuum cleaner, a tank-type wet/dry vacuum cleaner or the like.

Figure 2:
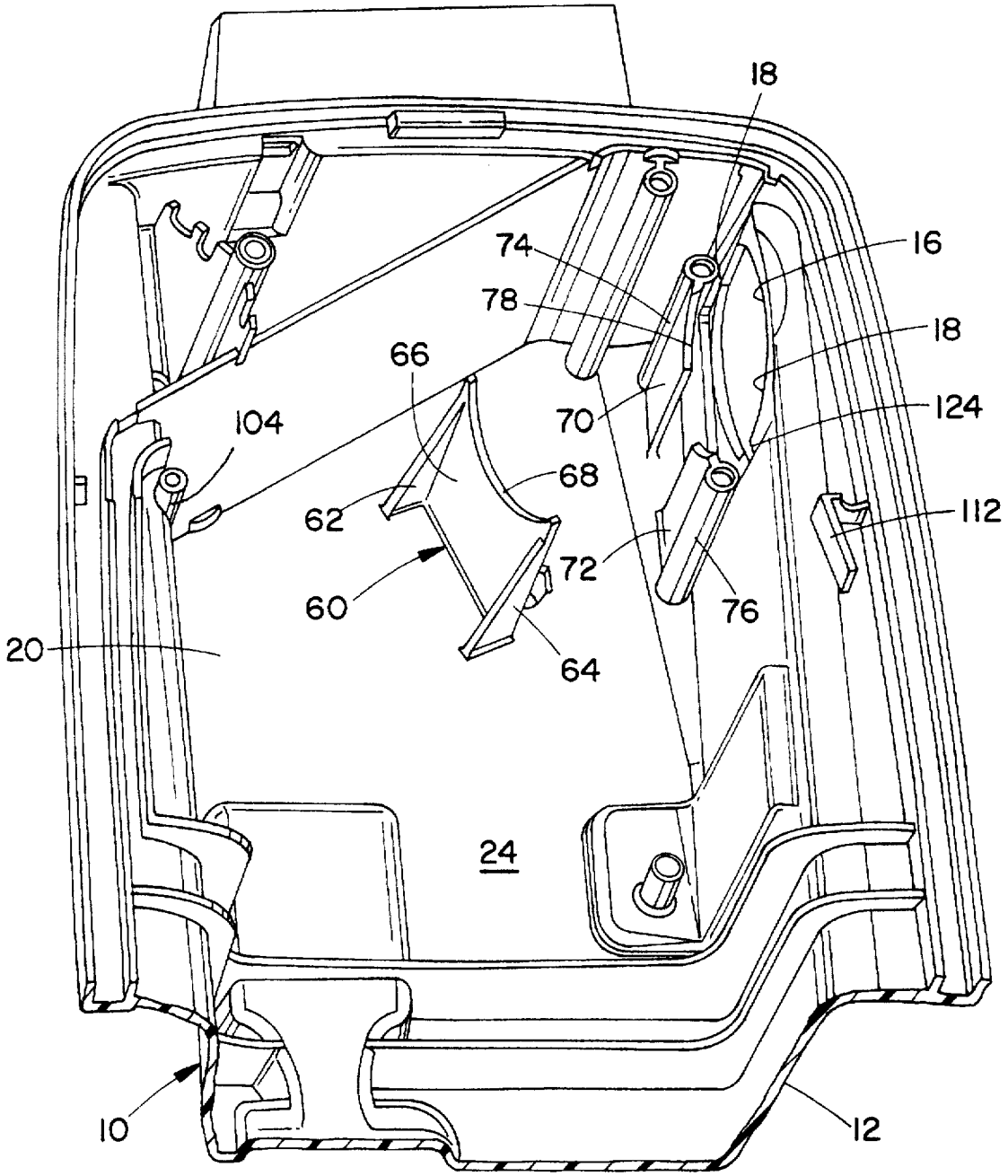
FIG. 2 is a front elevational view of the housing of FIG. 1.
Figure 3:
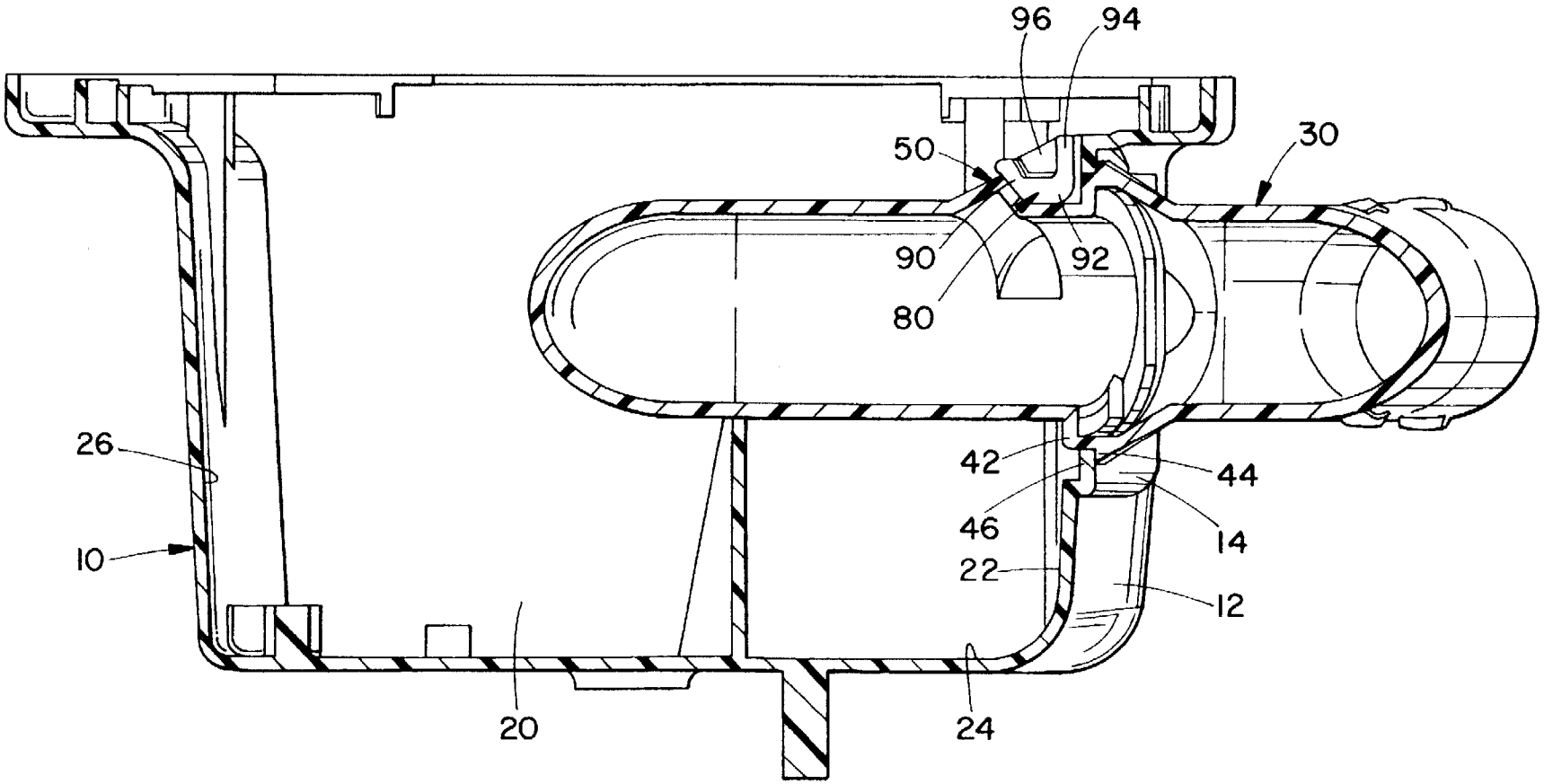
FIG. 3 is an enlarged cross-sectional view of the conduit, housing and clamp of FIG. 1 in an assembled condition.

With reference now to FIG. 3, a vacuum cleaner housing 10 according to the present invention includes an exterior wall 12 having a raised section 14 through which a hole 16 (FIG. 2) extends. The hole 16 is substantially circular, although it can have a pair of opposed flats 18 (FIG. 2). The housing is preferably made of a rigid, air impervious material and is shaped to form a tub-like chamber 20. The chamber 20 is defined in cross section by a first interior side wall 22, a base wall 24 and a second interior side wall 26.

Figure 6:
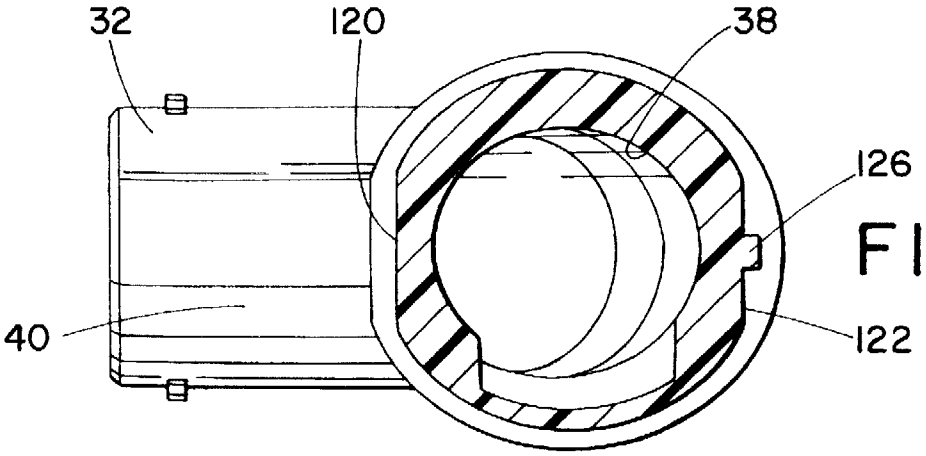
FIG. 6 is a cross-sectional view through the conduit of FIG. 5.

Extending through the hole 16 is a conduit or fill tube 30. With reference now also to FIG. 4, the conduit includes an inlet end 32 which cooperates with and receives dust laden air from an associated, preferably flexible, tube 33 and a central portion 34, which extends through the hole 16, as well as an outlet end 36. As shown in FIG. 6, the conduit has an inner periphery 38 and an outer periphery 40. Preferably the inner periphery of the conduit is of a substantially circular cross-section having substantially a single diameter along substantially its entire length.

Figure 5:
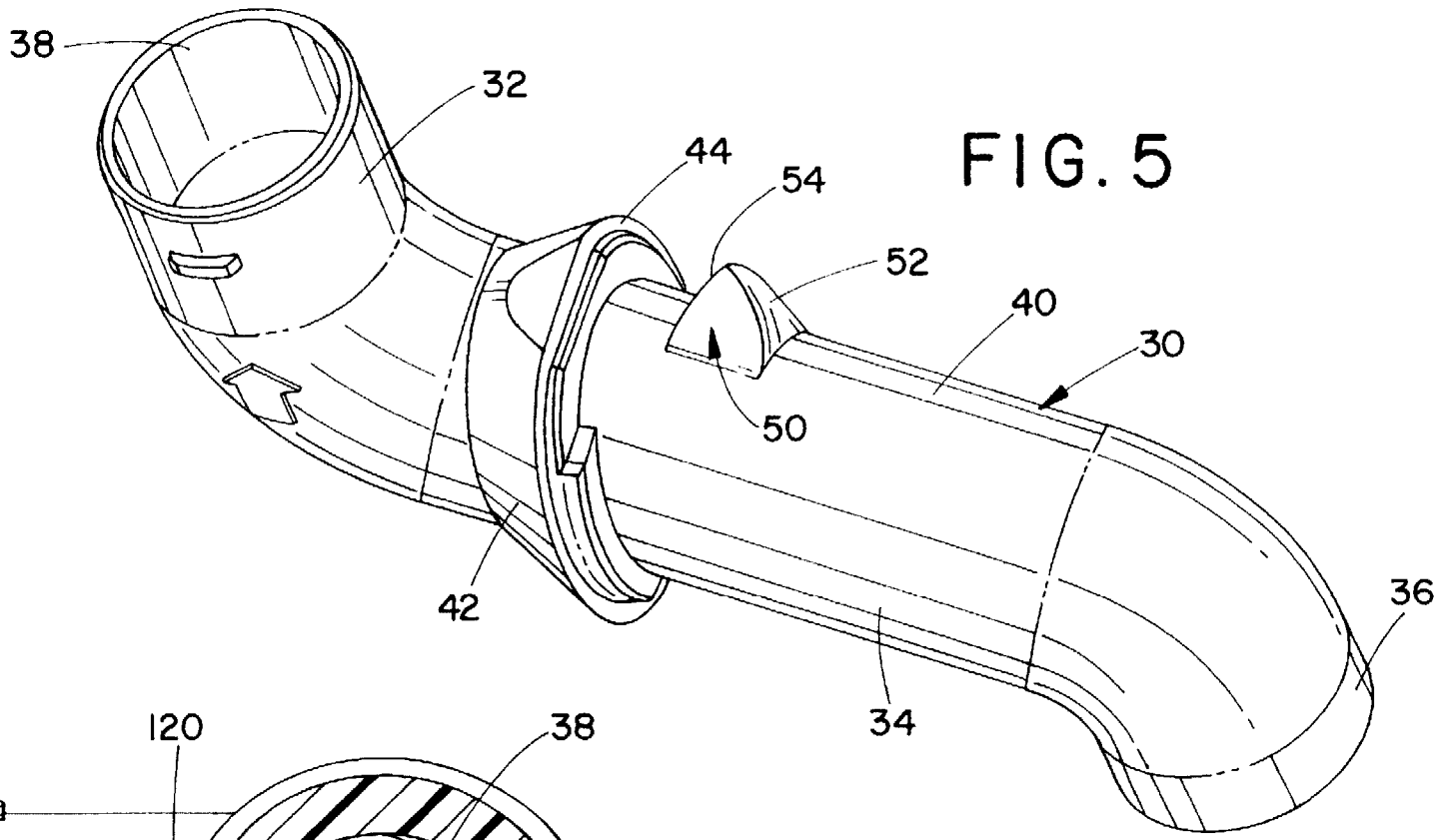
FIG. 5 is an enlarged perspective view of the tubular conduit of FIG. 1.

Extending radially outwardly from the outer periphery 40 of the conduit 30 is a flange 42. As shown in FIG. 5, the flange extends circumferentially around the conduit 30 at an acute angle to the axis of the conduit. Extending circumferentially around the periphery of the flange is a shoulder 44. As illustrated in FIG. 3, the shoulder 44 abuts a wall section 46 surrounding the hole 16 in order to serve as a means for limiting the sliding movement of the conduit 30 into the housing 10. The flange 42 also serves as a sealing means for sealing the conduit 30 against the housing 10 in order to prevent the suction of air through the hole 16 when a motorized fan (not illustrated) pulls a suction in the chamber 20.

Extending radially outwardly from the conduit outer periphery 40 in a manner spaced from the flange 42 is a rib 50. The rib 50 extends over only about 180 degrees of the circumference of the conduit 30, as may best be seen in FIGS. 1 and 5. Also, the rib is of a substantially smaller diameter than the flange 42 so as to enable the conduit 30 to be slid via its outlet end 36 through the hole 16 and into the housing until the shoulder 44 of the flange contacts the wall section 46 surrounding the hole 16. As illustrated in FIG. 5, the rib 50 includes a first tapered slope 52 facing toward the outlet end 36 and a second tapered slope 54 facing towards the inlet end 32 of the conduit 30.

With reference now to FIG. 2, a support means is provided in the chamber 20 of the housing 10 for supporting the conduit 30. More specifically, protruding from the base wall 24 into the chamber 20 is a support arm 60 having a pair of spaced side walls 62 and 64 which are spanned by a bracing wall 66 having a concave top surface 68. Positioned adjacent the hole 16 through the housing side wall 22 and protruding from the base wall 20 into the chamber 20 are first and second support fingers 70 and 72. Each of these includes a respective first and second socket 74 and 76. The support fingers each have a concave top surface 78.

Figure 1:
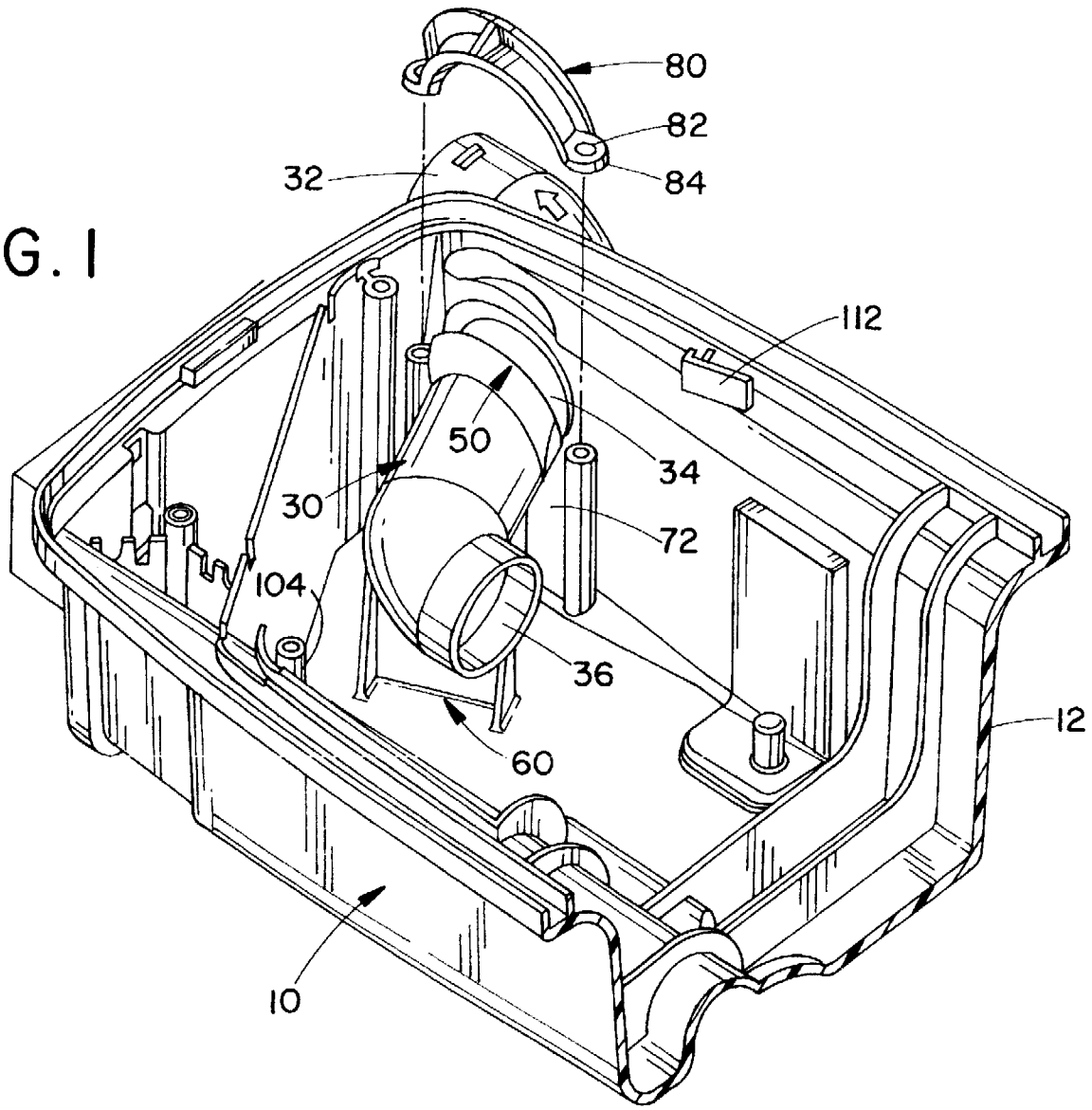
FIG. 1 is an exploded perspective view of a tubular conduit, a vacuum cleaner housing and a clamp according to the preferred embodiment of the present invention.

As shown in FIG. 1, the conduit is supported on the arm 60 near its outlet end 36 and is supported by the is fingers 70 and 72 at its central portion 34 where the conduit extends through the hole 16. The rib 50 of the conduit is so located that it is immediately adjacent the support fingers 70 and 72 and is located radially inwardly therefrom. Cooperating with the rib 50 and the support finger sockets 74 and 76 is a clamp 80. The clamp is somewhat U-shaped or semicircular and has apertures 82 extending through its ends 84. A respective fastener 86 (FIG. 4) extends through the apertures 82 and into a respective one of the sockets 74 and 76 to secure the clamp to the housing fingers 70, 72. It should be appreciated that the fastener can be a threaded member, such as a screw, with the sockets being suitably threaded in order to engage the threads of the screw.

With reference now again to FIG. 3, the central portion of the clamp 80 between its ends 84 is somewhat U-shaped in cross section. It comprises a tapered front face 90, a flat bottom face 92 and a flat back face 94. Preferably at least one reinforcing rib 96 extends between the front face 90 and the back face 94 in order to stiffen the clamp. The front tapered face 90 is suitably tapered as to enable it to cooperate with the second tapered slope 54 of the rib 50 so that the clamp acts like a wedge to tighten the conduit or fill tube in place in the housing around about 180 degrees of the circumference of the conduit. In other words, the slope 54 and the face 90 have matching angles to allow for a good fit of these two elements with each other. At the same time, the remaining 180 degree circumference of the conduit is pulled tightly against the first and second support fingers 70 and 72 which are shown in FIG. 2. Simultaneously, the conduit is pulled against the support arm 60. With this construction, the conduit is tightly held in the housing 10.

It should be appreciated that the vertical back face 94 of the clamp 80 is of a larger dimension than is the tapered front face 90 so that the clamp back face engages against both the flange 42 of the conduit and the wall section 46 of the housing surrounding the hole 16. This can be seen in FIG. 3 of the drawings. In this way, the clamp 80 serves as a means for preventing the conduit 30 from being withdrawn from the housing 10.

With reference now again to FIG. 4, a mounting plate 100 is pivotally mounted via a pivot pin 102 rotatably held in a hinge barrel 104 located in the chamber 20 of the housing. The mounting plate holds a reinforced collar 106 of a dirt receiving bag 108. When the mounting plate is correctly positioned, the collar 106 of the bag 108 engages the outlet end 36 of the conduit 30 so as to enable dust laden air which flows through the conduit to flow into the bag 108. In order to secure the mounting plate 100 in a stable position in the housing 10, a finger 110 of the mounting plate cooperates with an ear 112 extending into the chamber 20 of the housing. This construction is known from applicant's prior U.S. Pat. No. 5,089,038 which is incorporated herein by reference in its entirety. In use, a front plate (not illustrated) covers the open front face of the housing 10 to form a sealed chamber for the bag 108.

With reference now again to FIGS. 2 and 6, the flats 18 provided on the two sides of the hole 16 extending through the housing 10 are meant to cooperate with suitable flattened portions 120 and 122 located on opposed sides of the conduit 30 at the central portion 34 thereof where the conduit extends through the hole 16. The flattened portions 120, 122 prevent the conduit 30 from rotating in relation to the housing 10.

If desired, a keyway 124 can be provided in the hole 16 extending through the housing 10. The keyway cooperates with a suitable key 126 located on the outer surface 40 of the conduit 30 and extending from the flattened section 122 so as to further prevent any undesirable rotation of the conduit 30 in relation to the housing 10.

The conduit, or fill tube 30, is preferably made from a suitable conventional plastic material such as high density polyethylene via a conventional means such as blow molding. In contrast, the housing 10 and the clamp 80 are preferably made from a different suitable conventional thermoplastic material, such as ABS, by conventional means.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. A container construction for a vacuum cleaner, comprising:

a housing enclosing a dirt receptacle for the vacuum cleaner, said housing including a wall;

a hole extending through the wall of the housing;

a tubular conduit extending through said hole in said wall, said conduit having an inlet end located outside said housing and an outlet end located inside said housing, said conduit comprising:

a flange extending radially outwardly from an outer periphery of said conduit, said flange being sized to contact said wall of said housing, and a rib extending radially outwardly from said conduit outer periphery in spaced relation to said flange; and, a clamp cooperating with said rib and said housing to secure said conduit to said housing.

2. The container construction of claim 1 wherein said housing further comprises a support arm for supporting said outlet end of said tubular conduit in said housing.

3. The container construction of claim 1 wherein said housing further comprises a support finger including a socket formed therein and wherein said container construction further comprises a fastener extending through an aperture in said clamp and into said socket for fastening said clamp to said support finger and thereby securing said conduit to said housing.

4. The container construction of claim 1 wherein said rib and said clamp have mating tapered surfaces to tightly interengage said clamp with said conduit.

5. The container construction of claim 1 wherein said conduit flange includes a shoulder which abuts a wall section of said housing surrounding said hole.

6. The container construction of claim 1 wherein said conduit has an outer surface including a flat which cooperates with a suitably shaped portion of said housing wall adjacent said aperture to prevent a rotation of said conduit in said housing.

7. The container construction of claim 1 wherein said inlet end cooperates with and receives dust-laden air from an associated tube and said outlet end cooperates with and is selectively attached to a bag located in said housing.

8. A container construction for a vacuum cleaner, comprising:

a rigid air-impervious vacuum cleaner housing forming a tub-like chamber;

a hole extending through a wall of the housing;

a tubular conduit extending through said hole in said wall, an inlet end located outside said housing and an outlet end located inside said housing, said conduit comprising:

a flange extending radially outwardly from an outer periphery of said conduit, said flange contacting an outer side of said housing, and a rib extending radially outwardly from said conduit outer periphery in spaced relation to said flange, said rib being located inside said housing; and, a clamp cooperating with said rib and said housing to secure said conduit to said housing.

9. The container construction of claim 8 wherein said housing further comprises a support arm located within said tub-like chamber of said housing for supporting said conduit in said housing.

10. The container construction of claim 8 wherein said housing further comprises a support finger including a socket formed therein and wherein said container construction further comprises a fastener extending through an aperture in said clamp and into said socket for fastening said clamp to said support finger and thereby securing said conduit to said housing.

11. The container construction of claim 8 wherein said rib and said clamp have tapered interengaging surfaces to tightly secure said clamp to said conduit.

12. The container construction of claim 8 wherein said conduit inlet end cooperates with and receives dust-laden air from an associated tube and said outlet end cooperates with and is selectively attached to a dirt receptacle located in said housing.

13. The container construction of claim 8 wherein said conduit has an outer surface including a flat which cooperates with a suitably shaped portion of said housing wall adjacent said aperture to prevent a rotation of said conduit in said housing.

14. The dirt receptacle construction of claim 13 wherein said conduit comprises a rigid material which is bent into a somewhat S-shaped configuration.

15. The container construction of claim 8 wherein said conduit flange includes a shoulder which abuts a wall section of said housing surrounding said hole to seal said conduit against said housing.

16. A container construction for a vacuum cleaner, comprising:

an air-impervious vacuum cleaner housing;

a hole extending through a wall of said housing;

a one-piece tubular conduit extending through said hole in said wall, said conduit having an inlet end located outside said housing and an outlet end located inside said housing, said conduit comprising:

a first means for preventing a movement of said conduit into said housing, said first means comprising a radially enlarged first conduit portion contacting an outer side of said housing, and a second means for preventing a movement of said conduit out of said housing, said second means being spaced from said first means and comprising a radially enlarged second conduit portion in spaced relation to said first conduit portion, said radially enlarged second conduit portion being radially smaller than said hole in said wall of said housing.

17. The container construction of claim 16 wherein said second means further comprises a clamp cooperating with said second conduit portion and said housing.

18. The container construction of claim 17 wherein said second means further comprises:

a socket located in said housing; and, a fastener extending through an aperture in said clamp and into said socket for fastening said clamp to said housing and thereby securing said conduit to said housing.

19. The container construction of claim 16 wherein said first means for preventing a movement of said conduit into said housing further comprises a seal means positioned between said radially enlarged first conduit portion and said housing for sealing said hole in said housing through which said tubular conduit extends in order to prevent air flow between said tubular conduit and said housing.

20. The container construction of claim 16 further comprising a support means for supporting said conduit within said housing.

21. The container construction of claim 20 wherein said support means comprises a support arm extending within said housing and contacting a peripheral portion of said conduit.

22. The container construction of claim 21 wherein said support means further comprises a pair of spaced support fingers which are spaced from said support arm, wherein each of said support fingers contacts a peripheral portion of said conduit.

* * * * *